US010748732B2

(12) United States Patent
Eberl et al.

(10) Patent No.: US 10,748,732 B2
(45) Date of Patent: Aug. 18, 2020

(54) MICROELECTROMECHANICAL LIGHT EMITTER COMPONENT, LIGHT EMITTER COMPONENT AND METHOD FOR PRODUCING A MICROELECTROMECHANICAL LIGHT EMITTER COMPONENT

(71) Applicant: Infineon Technologies AG, Neubiberg (DE)

(72) Inventors: Matthias Eberl, Taufkirchen (DE); Franz Jost, Stuttgart (DE); Stefan Kolb, Unterschleissheim (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 16/186,678

(22) Filed: Nov. 12, 2018

(65) Prior Publication Data

US 2019/0148101 A1 May 16, 2019

(30) Foreign Application Priority Data

Nov. 13, 2017 (DE) ..... 10 2017 126 635

(51) Int. Cl.
*H01J 19/78* (2006.01)
*H01J 19/54* (2006.01)

(52) U.S. Cl.
CPC ..... *H01J 19/78* (2013.01); *H01J 19/54* (2013.01)

(58) Field of Classification Search
CPC .. G01J 5/0862; H01L 31/02325; H01L 31/18; H01K 11/00; H01K 1/04; H01K 1/14; H01K 1/16; H01K 1/62; H01K 3/02
USPC ..... 257/79
See application file for complete search history.

(56) References Cited

U.S. PATENT DOCUMENTS

| | | | | |
|---|---|---|---|---|
| 8,013,600 | B1 | 9/2011 | Yepes et al. | |
| 9,054,491 | B1 * | 6/2015 | Hurlbut | H01S 1/00 |
| 2006/0044101 | A1 * | 3/2006 | Frutschy | H01F 27/027 336/200 |
| 2008/0136442 | A1 | 6/2008 | Chen | |
| 2008/0296606 | A1 * | 12/2008 | Ottobon | G06K 19/0728 257/100 |
| 2012/0104385 | A1 | 5/2012 | Godo et al. | |
| 2014/0146011 | A1 * | 5/2014 | Huang | G06F 3/046 345/174 |

(Continued)

FOREIGN PATENT DOCUMENTS

| | | |
|---|---|---|
| CN | 103247727 A | 8/2013 |
| CN | 105576089 A | 5/2016 |

OTHER PUBLICATIONS

Wikipedia Artikel, "Induktionskochfeld", 7 pages, [Retrieved on Mar. 13, 2020].

*Primary Examiner* — Duy T Nguyen
(74) *Attorney, Agent, or Firm* — Harrity & Harrity, LLP

(57) ABSTRACT

A microelectromechanical light emitter component comprises an emitter layer structure of the microelectromechanical light emitter component and an inductive structure of the microelectromechanical light emitter component. The inductive structure of the microelectromechanical light emitter component is configured to generate current in the emitter layer structure by electromagnetic induction, such that the emitter layer structure emits light. The emitter layer structure is electrically insulated from the inductive structure.

20 Claims, 11 Drawing Sheets

(56) References Cited

U.S. PATENT DOCUMENTS

| | | | | |
|---|---|---|---|---|
| 2015/0023023 | A1* | 1/2015 | Livesay | H01L 33/641 362/294 |
| 2015/0242660 | A1 | 8/2015 | Baarman et al. | |
| 2015/0311401 | A1 | 10/2015 | Santhanam et al. | |
| 2016/0057830 | A1* | 2/2016 | Klett | H02J 50/20 315/32 |

* cited by examiner

MICROELECTROMECHANICAL LIGHT EMITTER COMPONENT, LIGHT EMITTER COMPONENT AND METHOD FOR PRODUCING A MICROELECTROMECHANICAL LIGHT EMITTER COMPONENT

RELATED APPLICATIONS

This application claims priority under 35 U.S.C. § 119 to German Patent Application No. 102017126635.6, filed on Nov. 13, 2017, the contents of which are incorporated by reference herein in their entirety.

TECHNICAL FIELD

Examples relate to concepts for generating light and applications in this regard, and in particular to microelectromechanical light emitter components, light emitter components and methods for producing microelectromechanical light emitter components.

BACKGROUND

Light emitter components can be implemented in various ways. Light emitter components having high light emission and energy efficiency are desirable.

SUMMARY

There may be a need to provide concepts for light emitter components having increased energy efficiency and/or increased light emission.

Such a need can be met by the subject matter of the claims.

Some example embodiments relate to a microelectromechanical light emitter component. The microelectromechanical light emitter component comprises an emitter layer structure of the microelectromechanical light emitter component and an inductive structure of the microelectromechanical light emitter component. The inductive structure of the microelectromechanical light emitter component is configured to generate current in the emitter layer structure by electromagnetic induction, such that the emitter layer structure emits light. The emitter layer structure is electrically insulated from the inductive structure.

Some example embodiments relate to a light emitter component. The light emitter component comprises an emitter layer structure, an inductive structure and at least one section of a cavity. The inductive structure is configured and arranged to generate current in the emitter layer structure by electromagnetic induction, such that the emitter layer structure emits light. The at least one section of the cavity extends vertically from the emitter layer structure as far as the inductive structure. The emitter layer structure extends vertically as far as maximally a lateral plane of the inductive structure.

Some example embodiments relate to a method for producing a microelectromechanical light emitter component. The method furthermore comprises forming an emitter layer structure of the microelectromechanical light emitter component. The method comprises forming an inductive structure of the microelectromechanical light emitter component. The microelectromechanical light emitter component is configured to generate current in the emitter layer structure by electromagnetic induction during operation of the microelectromechanical light emitter component, such that the emitter layer structure emits light. The emitter layer structure is electrically insulated from the inductive structure.

BRIEF DESCRIPTION OF THE DRAWINGS

Some examples of devices and/or methods are described below exclusively by way of example and with reference to the accompanying drawings, in which

FIG. 7 shows a schematic exploded drawing of a microelectromechanical light emitter component;

DETAILED DESCRIPTION

Various example embodiments will now be described more thoroughly and with reference to the accompanying drawings. In the figures, the thickness of the lines, layers and/or regions may be exaggerated for the sake of clarity.

While further examples are accordingly suitable for various modifications and alternative forms, some examples thereof are shown by way of example in the figures and described thoroughly here. It goes without saying, however, that the intention is not to limit examples to the specific forms described. Further examples can cover all modifications, counterparts and alternatives that fall within the scope of the disclosure. Throughout the description of the figures, identical reference signs refer to identical or similar elements which can be implemented identically or in modified form in a comparison with one another, while they provide the same or a similar functionality.

It goes without saying that if one element is designated as "connected" or "coupled" to another element, the elements can be connected or coupled directly or via one or more intermediate elements. If two elements A and B are combined using an "or", this should be understood such that all possible combinations are disclosed, i.e. only A, only B, and A and B. An alternative wording for the same combinations is "at least one from A and B". The same applies to combinations of more than 2 elements.

The terminology used herein aims to describe specific examples and is not intended to be limiting for further examples. Whenever a singular form such as "a, an" and "the" is used and the use of only one element is defined neither explicitly nor implicitly as obligatory, further examples can also comprise the plural forms in order to implement the same functionality. In a similar way, if a functionality is described below in such a way that it is implemented using a plurality of elements, further examples can implement the same functionality using a single element or a single processing entity. Furthermore, it goes without saying that the terms "comprises", "comprising", "have", "contains", "containing" and/or "having" in their usage herein indicate the presence of indicated features, integers, steps, operations, elements and/or components, but do not exclude the presence or addition of one or more other features, integers, steps, operations, elements, components and/or groups thereof.

Unless defined otherwise, all terms used here (including technical and scientific terms) are used in their customary meaning in the field with which the examples are associated.

Figure 1:
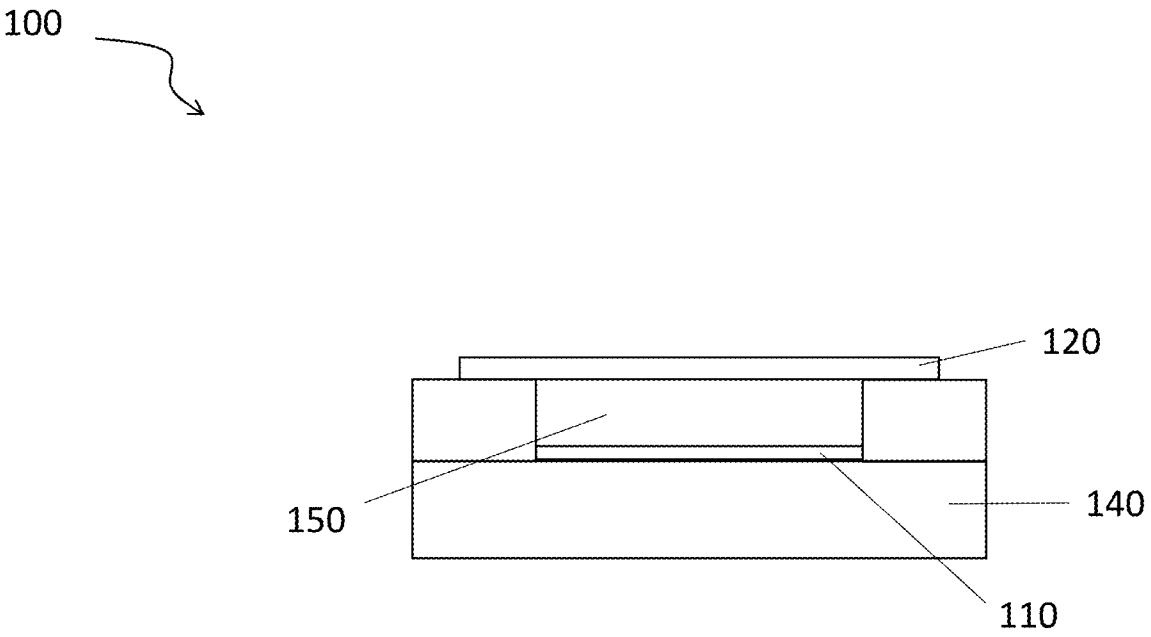
FIG. 1 shows a schematic cross section of a part of a microelectromechanical light emitter component.

FIG. 1 shows a schematic cross section of a part of a microelectromechanical light emitter component 100 in accordance with one example embodiment. The microelectromechanical light emitter component 100 comprises an emitter layer structure 110 of the microelectromechanical light emitter component 100 and an inductive structure 120 of the microelectromechanical light emitter component 100. The inductive structure 120 of the microelectromechanical light emitter component 100 is configured to generate current in the emitter layer structure 110 by electromagnetic induction, such that the emitter layer structure 110 emits light. The emitter layer structure 110 is electrically insulated from the inductive structure 120.

On account of the electrical and thermal decoupling of the emitter layer structure 110 and the inductive structure 120, an increased energy efficiency can be achieved since heat losses resulting from leads to the emitter layer structure 110 can be avoided. As a result, a power consumption of the light emitter component 100 can be reduced and/or the light emission can be increased.

The inductive structure 120 can be a coil. The coil can have one or more windings in one or more layer planes of the microelectromechanical light emitter component 100. The coil can have a plurality of planes of windings. As a result, it is possible to achieve a desired field direction and/or field strength of the magnetic field by means of an excitation current through the coil in order to set an induced current in the emitter layer structure 110.

For example, the emitter layer structure 110 can be a two-dimensional emitter layer structure that extends in lateral directions. The emitter layer structure 110 can be for example a completely continuous layer without holes. Alternatively, the emitter layer structure 110 can be structured and have one or more holes (e.g. in the center). As a result, etching of sacrificial layers above or below the emitter layer structure 110 after the production of the emitter layer structure 110 can be made possible.

The emitter layer structure 110 can be suspended completely circumferentially at the edge of a cavity. Alternatively, for the suspension of the emitter layer structure 110, the emitter layer structure 110 can have webs facing away from the emitter layer structure 110 in a radial direction, spirally or in some other direction in order to suspend the emitter layer structure 110. The webs can have a thickness the same as a thickness of the emitter layer structure 110, and/or comprise the same material as the emitter layer structure 110.

For example, the emitter layer structure 110 can be configured and arranged to be free of potential (electrically floating) during operation of the microelectromechanical light emitter component 100. The emitter layer structure 110 is not electrically connected to a terminal, for example, and no external voltage is applied to the emitter layer structure 110. Alternatively, the emitter layer structure 110 can be electrically contacted and connected to a reference potential (e.g. ground) during operation.

On account of being kept free of potential, this may result in an improved thermal energy utilization since otherwise thermal losses might also arise in the case of connections to electrical leads on the basis of the relationship that electrical conductivity is proportional to the thermal conductivity.

The emitter layer structure 110 and/or the inductive structure 120 can form a micromechanical element of the microelectromechanical light emitter component 100 and/or be produced by production processes for microelectromechanical systems MEMS. By way of example, the emitter layer structure 110 and/or the inductive structure 120 can be implemented as a membrane structure.

For example, the microelectromechanical light emitter component 100 can furthermore comprise at least one section of a cavity 150. The cavity 150 can be arranged vertically between the emitter layer structure 110 and the inductive structure 120. The cavity 150 between the emitter layer structure 110 and the inductive structure 120 can have a vertical extent of less than 1 mm (or less than 500 μm, less than 100 μm, less than 10 μm or less than 1 μm) and/or more than 100 nm (or more than 500 nm). By way of example, there can be a gas pressure or air pressure of less than 10 mbar (or less than 1 mbar) in the cavity between the emitter layer structure 110 and the inductive structure 120. Heat dissipation away from the emitter layer structure 110 can be reduced as a result.

In interspaces between conductive parts of the inductive structure 120, the inductive structure 120 can comprise a cavity or voids or an oxide, such that the cavity 150 extends only between the inductive structure 120 and the emitter layer structure 110 or is connected by the voids in the interspaces to a further part of the cavity on the other side of the inductive structure.

By way of example, the inductive structure 120 can be arranged with respect to the emitter layer structure 110 such that eddy currents are induced in the emitter layer structure 110 by the inductive structure 120 if an excitation current flows through the inductive structure 120. The arrangement of the inductive structure relative to the emitter structure can thus be effected such that eddy currents are induced in the emitter structure, e.g. therebelow, thereabove, on the left, on the right and/or in an enclosing manner (e.g. FIG. 10).

For example, the inductive structure 120 can be designed to generate a magnetic field having a field direction at a point of maximum field strength during operation. The field direction and a surface of the emitter layer structure 110 can form an angle of between 80° and 100°. Currents could thereby be induced in the emitter layer structure 110 with high efficiency.

For example, the microelectromechanical light emitter component 100 can furthermore comprise a multiplicity of emitter layer structures 110 of the microelectromechanical light emitter component 100. The emitter layer structures 110 can be arranged in a manner distributed laterally. The emitter layer structures 110 can be electrically insulated from one another. As a result, the maximum light emission of the microelectromechanical light emitter component 100 can be increased and/or light at different wavelengths can be emitted by the different emitter layer structures.

The emitter layer structure 110 can be a single layer composed of a single material or can comprise a plurality of layers. The emitter layer structure 110 can comprise for example a carrier layer (e.g. electrically insulating layer) and an emitter layer (e.g. electrically conductive layer). By way of example, the emitter layer structure 110 can comprise a passivation layer and/or an anti-adhesion layer at a top side and/or an underside of an emitter layer. For example, the emitter layer structure 110 or the emitter layer of the emitter layer structure 110 can comprise a metal (e.g. platinum), polysilicon, silicon carbide, graphene or graphite. The emitter layer structure 110 or the emitter layer of the emitter layer structure 110 can be for example a metal layer, a polysilicon layer, a silicon carbide layer, a graphene layer or a graphite layer. By way of example, the graphene layer or the graphite layer can be in monolayer form, that is to say be a monolayer, or have fewer than 20 atomic layers. The emitter layer structure 110 can have for example a thickness of less than 200 μm (or less than 100 μm, less than 10 μm, less than 1 μm, less than 100 nm or less than 20 nm). The emitter layer structure 110 can have for example a lateral extent of greater than 50 μm (or greater than 100 μm or greater than 500 μm) and/or less than 10 mm (or less than 5 mm or less than 1 mm). By way of example, a high emissivity of the microelectromechanical light emitter component 100 can be achieved through the use of graphene and graphite.

The emitter layer structure 110 and/or the inductive structure 120 can be implemented on a carrier substrate 140. The carrier substrate can be for example a semiconductor substrate (e.g. silicon substrate) or a glass substrate. For example, the emitter layer structure 110 can be arranged between the inductive structure and a carrier substrate 140. The emitter layer structure 110 and the inductive structure 120 can be produced on the carrier substrate and be carried by the latter. The carrier substrate 140 can have a cavity extending from a rear side of the carrier substrate as far as the emitter layer structure 110 or the inductive structure 120. An insulating layer can be formed on the carrier substrate 140, said insulating layer electrically insulating the carrier substrate 140 from the emitter layer structure 110 and/or the inductive structure 120. The carrier substrate 140 can have a vertical extent (thickness) of a maximum of 1 mm (or less than 500 μm, less than 100 μm or less than 10 μm).

For example, the microelectromechanical light emitter component 100 can furthermore comprise a driver circuit (not shown) of the microelectromechanical light emitter component. The driver circuit can be designed for providing an excitation current to the inductive structure 120 in order to excite light emission by the emitter layer structure 110. The driver circuit and the inductive structure 120 can be implemented on the same carrier substrate 140 (e.g. silicon substrate). In addition, the microelectromechanical light emitter component 100 can comprise a device for monitoring the emitter, such as, for example, the radiation power (e.g. by means of an integrated photodiode).

For example, the microelectromechanical light emitter component 100 can furthermore comprise two connection pads, a first connection pad and a second connection pad of the microelectromechanical light emitter component 100. The first connection pad can be connected to a first connection end of the inductive structure 120. The second connection pad can be connected to a second connection end of the inductive structure 120. The first connection pad and the second connection pad can be configured to be connected to an external driver circuit for providing an excitation current to the inductive structure 120. The connection pads can be connected for example to an outgoing conductor and a return conductor of the inductive structure, such that a driver circuit for providing an excitation current to the inductive structure 120 is connectable externally in order to excite light emission by the emitter layer structure. By way of example, it may be sufficient for the microelectromechanical light emitter component 100 to comprise exclusively or only two connection pads and no further connection pad, since it may be sufficient to connect the inductive structure for providing the excitation current. As a result, the microelectromechanical light emitter component 100 could be produced with low complexity and costs. The outgoing conductor and the return conductor could lead in each case to a connecting part of the inductive structure 120. In the case of exactly one coil, one of the two outgoing conductors or return conductors can lead to a connection point of the coil which is arranged in the center of the lateral extent of the coil. Furthermore, the other of the two outgoing conductors or return conductors can correspondingly lead to a connection point of the coil which is arranged at an edge of the lateral extent of the coil.

For example, a distance between the emitter layer structure 110 and the inductive structure 120 can be greater than 1 μm (or greater than 10 μm or greater than 100 μm). The distance between the emitter layer structure 110 and the inductive structure 120 can be less than 1 mm (or less than 500 μm or less than 100 μm).

A reduced distance can make possible a microelectromechanical light emitter component 100 having smaller dimensions, whereas a larger distance could improve the thermal insulation of the emitter layer structure.

For example, the current generated by electromagnetic induction can be generated by a voltage being applied to electrical contacts of the inductive structure 120. For example, the excitation current that flows through the inductive structure for inducing the current in the emitter layer structure can be less than 100 mA (or less than 50 mA, less than 10 mA, less than 5 mA or less than 1 mA). The excitation current can be an alternating current, for example, in order to generate a temporally varying magnetic field. By way of example, the emitter layer structure 110 or an emitter layer of the emitter layer structure 110 can be heated by the induced current to a temperature of more than 400° C. (or more than 500° C. or more than 700° C.) and/or less than 1000° C. (or less than 800° C.) in order to emit light. The excitation current can be supplied by a supply circuit or the driver circuit which is implemented on a carrier substrate 140, or by an external supply circuit or driver circuit. The external supply circuit or driver circuit can be connected to the connection pads. The carrier substrate can have a vertical extent of less than 1 mm.

The flow of the current generated by electromagnetic induction through the emitter layer structure 110 can cause Joule heating of the emitter layer structure 110 and can thereby lead to an emission of a thermal radiation by the emitter layer structure. In addition, the inductive structure can also be heated (e.g. by the excitation current), such that a heat dissipation from the emitter layer structure is reduced, for example. By way of example, the emitter layer structure 110 can be configured to emit thermal radiation in the form of infrared light (e.g. light having a wavelength in the range of 700 nm to 1 mm) and/or visible light (e.g. light having a wavelength in the range of 400 nm to 700 nm) and/or a combination thereof. By way of example, the emitter layer structure 110 can be configured to emit light with a spectrum having a maximum intensity at a wavelength of greater than 700 nm and less than 1 mm. A radiation or emission of light in a vacuum can enable a heat conduction through a large air interface with a small interspace. By way of example, the emitter layer structure 110 can be designed to emit light with an intensity maximum at a frequency of greater than 300 GHz and less than 400 THz upon excitation of a defined induced current by the inductive structure. This frequency range corresponds to the spectrum of the infrared range.

By way of example, the microelectromechanical light emitter component 100 can be an infrared emitter or a microelectromechanical infrared emitter. By way of example, the light emitter component 100 can be an element of a photoacoustic gas sensor, of a photoacoustic spectroscopy system, of a thermal flux sensor or of a mobile device (e.g. of a smartphone or of a tablet computer). The light emitter component 100 can be used to realize any other gas sensor principle where emitted optical radiation is used to trigger a sensor effect, such as e.g. nondispersive infrared sensor NDIR sensor systems.

Figure 2:
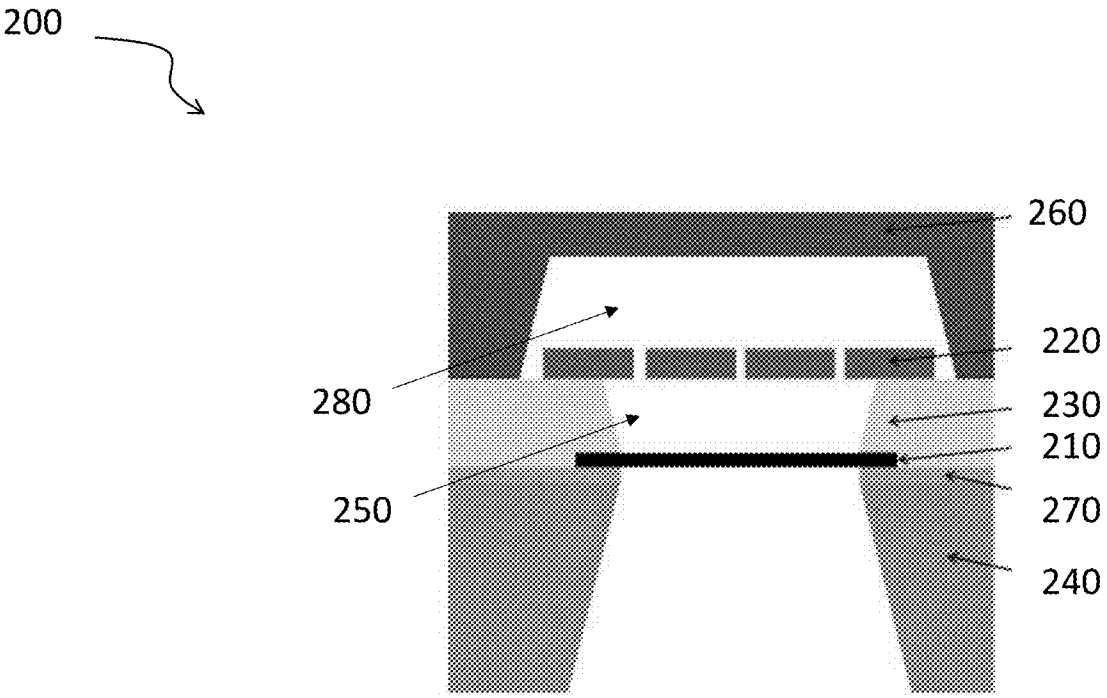
FIG. 2 shows a schematic cross section of a part of a microelectromechanical light emitter component with a covering structure.

By way of example, the microelectromechanical light emitter component 200, as shown in FIG. 2, can furthermore comprise a further emitter layer structure (not shown) of the microelectromechanical light emitter component. The inductive structure can be arranged between the emitter layer structure 210 and the further emitter layer structure. The inductive structure 220 can be configured to generate current in the further emitter layer structure by electromagnetic induction, such that the further emitter layer structure emits light, wherein the further emitter layer structure is electrically insulated from the inductive structure.

A further emitter layer structure can enable use possibilities, for example by doubled radiation intensity or coupling-out on different sides of the microelectromechanical light component.

By way of example, the microelectromechanical light emitter component can furthermore comprise at least one section of a cavity. The cavity can be arranged vertically between the inductive structure and the further emitter layer structure. The inductive structure can be arranged centrally between the emitter layer structure and the further emitter layer structure. The inductive structure can be at the same distance between the emitter layer structure and the further emitter layer structure. The further emitter layer structure can be arranged between the covering structure and the inductive structure 220.

By way of example, the microelectromechanical light emitter component can furthermore comprise a covering structure of the microelectromechanical light emitter component. The inductive structure 220 can be arranged between the emitter layer structure and the covering structure. The covering structure can have a recess in order to form a cavity vertically between the inductive structure, the covering structure and/or the emitter layer structure. The covering structure can be a glass cover. A separate glass cover can be fitted above each inductive structure.

By way of example, the microelectromechanical light emitter component can furthermore comprise at least one section of a cavity. The section can be arranged vertically between the inductive structure and the covering structure. The section can also be arranged vertically between the further emitter layer structure and the covering structure. The cavity between the covering structure and the inductive structure can comprise e.g. a minimum of 0 mm (or be larger than 10 nm, 100 nm, 1 μm or 10 μm). The cavity between the covering structure and the inductive structure can comprise e.g. a maximum of 5 mm (or be smaller than 1 mm, 100 μm, 10 μm, 1 μm or 100 nm).

By way of example, the carrier substrate can be a semiconductor substrate or a glass substrate. By way of example, at least one section of the covering structure 260 can be a semiconductor substrate or a glass substrate, for example the glass cover. By way of example, the semiconductor substrate can be a substrate based on silicon, a semiconductor substrate based on silicon carbide (SiC), a semiconductor substrate based on gallium arsenide (GaAs), or a semiconductor substrate based on gallium nitride (GaN). The semiconductor substrate can be a semiconductor chip or a part of a semiconductor wafer. By way of example, a glass substrate can be a glass substrate based on silica (e.g. $SiO_2$), a glass substrate based on borosilicate or a glass substrate based on aluminosilicate. A glass substrate can be a part of a glass wafer, of a glass cover wafer, or a glass cover.

Further details and aspects are mentioned in association with the example embodiments described above or below. The example embodiment shown in FIG. 1 can have one or more optional additional features corresponding to one or more aspects mentioned in association with the proposed concept or example embodiments described below (e.g. FIGS. 2-10).

FIG. 2 shows a schematic illustration of a microelectromechanical light emitter component 200 comprising a covering structure 260 in accordance with one example embodiment. The implementation of the microelectromechanical light emitter component 200 can be similar to the implementation of the microelectromechanical light emitter component described in association with FIG. 1.

The microelectromechanical light emitter component 200 comprises a first insulating layer 270 (e.g. oxide layer or nitride layer) on a silicon carrier substrate 240. An emitter layer structure 210 is formed on the first insulating layer 270 and a cavity extends from a side of the emitter layer structure 210 facing the silicon carrier substrate 240 as far as a rear side of the silicon carrier substrate 240. The emitter layer structure 210 bears by an edge region on the insulating layer 270 such that the emitter layer structure 210 forms a membrane which is carried or suspended at its edge. A second insulating layer 230 is formed on the emitter layer structure 210 and a part of the first insulating layer 270 that is not covered by the emitter layer structure 210. An inductive structure 220 is formed on the second insulating layer 230. The second insulating layer 230 is removed in a region between the second insulating layer 230 and the emitter layer structure 210, such that a cavity 250 is present between the second insulating layer 230 and the emitter layer structure 210. A covering structure 260 having a recess is arranged on the second insulating layer 230. The recess 280 is arranged in the region of the inductive structure 220, such that the inductive structure 220 extends at least partly into the recess 280.

By way of example, the emitter layer structure 210 can comprise a multiplicity of suspension and/or securing webs. The suspension webs can extend to an edge of the cavity in order to suspend the emitter layer structure 210 at the edge of a cavity 250. The suspension webs can be composed of the same material as the emitter layer structure 210. The suspension webs can have the same layer thickness as the emitter layer structure 210.

By way of example, the emitter layer structure 210 and the inductive structure 220 can be implemented in a layer stack on a semiconductor substrate. The layer stack construction can be produced by means of a production process for microelectromechanical systems.

By way of example, the covering structure 260 can optionally have an optical filter structure in the recess, such that light which passes through the optical filter has a spectral maximum at a desired optical wavelength. In this way, a wavelength of the emitted light can be controlled efficiently.

By way of example, the optical filter can comprise a Bragg filter having various polysilicon layers and/or insulating layers (e.g. layers comprising silicon oxide or silicon nitride) on a substrate (e.g. on a silicon substrate). By way of example, the optical filter can be arranged within the recess 280 (e.g. on a surface of the covering structure 260).

By way of example, the electrical insulation 230 between the inductive structure 220 and the emitter layer structure 210 can have the cavity 250 or at least one section of the cavity 250. A smoother light emission can be achieved as a result.

By way of example, the emitter layer structure 210 can comprise a material having a high optical emissivity at a wavelength of interest (e.g. black platinum, graphene, polysilicon or silicon). By way of example, the emitter layer structure 210 or an emitter layer of the emitter layer structure 210 can comprise graphene, graphite and/or a composite material comprising nanotubes. Graphene or graphite can be used e.g. owing to the high long-term stability. Other materials, primarily ferromagnetic materials having a high melting point (e.g. polysilicon and/or active PN-junction semiconductor materials), can alternatively be used for the emitter layer structure 210 or an emitter layer of the emitter layer structure 210.

By way of example, the electrical insulation 230 can comprise a nitride or an oxide (e.g. silicon oxide or silicon nitride).

By way of example, the emitter layer structure 210 can comprise a first layer comprising a first metal, and a second layer comprising a second metal. The second layer can cover the first layer. By way of example, the first metal can be titanium and the second metal can be platinum. Alternatively, the inductive structure can comprise a single metal layer. By way of example, the single metal layer can comprise tungsten.

By way of example, the covering structure 260 can be fitted to the microelectromechanical light emitter component 200 in a gastight manner. As a result, a reduced pressure can be generated in one or more of the cavities, for example, in order to reduce the heat dissipation from the emitter layer structure.

Further details and aspects are mentioned in association with the example embodiments described above or below. The example embodiment shown in FIG. 2 can have one or more optional additional features corresponding to one or more aspects mentioned in association with the proposed concept or one or more example embodiments described above (e.g. FIG. 1) or below (e.g. FIGS. 3-10).

Figure 3:
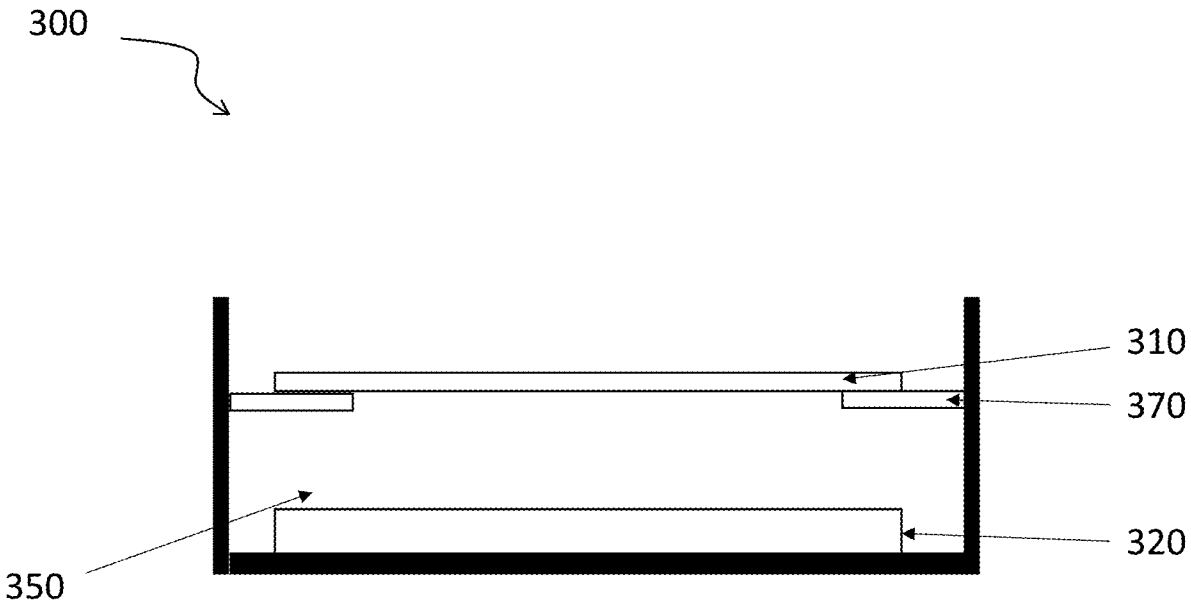
FIG. 3 shows a schematic cross section of a part of a light emitter component.

FIG. 3 shows a light emitter component 300 in accordance with one example embodiment. The light emitter component 300 comprises an emitter layer structure 310, an inductive structure 320 and at least one section of a cavity 350. The inductive structure 320 is configured and arranged to generate current in the emitter layer structure 310 by electromagnetic induction, such that the emitter layer structure 310 emits light. The at least one section of the cavity 350 extends vertically from the emitter layer structure 310 as far as the inductive structure 320. The emitter layer structure 310 extends vertically as far as maximally to a lateral plane of the inductive structure 320.

As a result, a direct electrical contacting of the emitter surface can be omitted since the electrical energy is transmitted via alternating magnetic and electric fields.

The lateral plane of the inductive structure 320 is for example a plane on which a layer of the inductive structure 320 is formed or a plane along a surface of a layer of the inductive structure 320. If the emitter layer structure 310 is arranged above the inductive structure 320, for example, then the emitter layer structure 310 does not extend to below the inductive structure 320. If the emitter layer structure 310 is arranged below the inductive structure 320, for example, then the emitter layer structure 310 does not extend to above the inductive structure 320. As a result, the emitter layer structure 310 and the inductive structure 320 can be implemented in a layer stack.

In this way, it is possible to efficiently form a light emitter component having little power loss on account of the decoupling of the inductive structure 220 and the emitter layer structure 210. It is thereby possible in turn to form a light emitter component having reduced power consumption.

Further details and aspects are mentioned in association with the example embodiments described above or below. The example embodiment shown in FIG. 3 can have one or more optional additional features corresponding to one or more aspects mentioned in association with the proposed concept or one or more example embodiments described above (e.g. FIGS. 1-2) or below (e.g. FIGS. 4-10).

Figure 4:
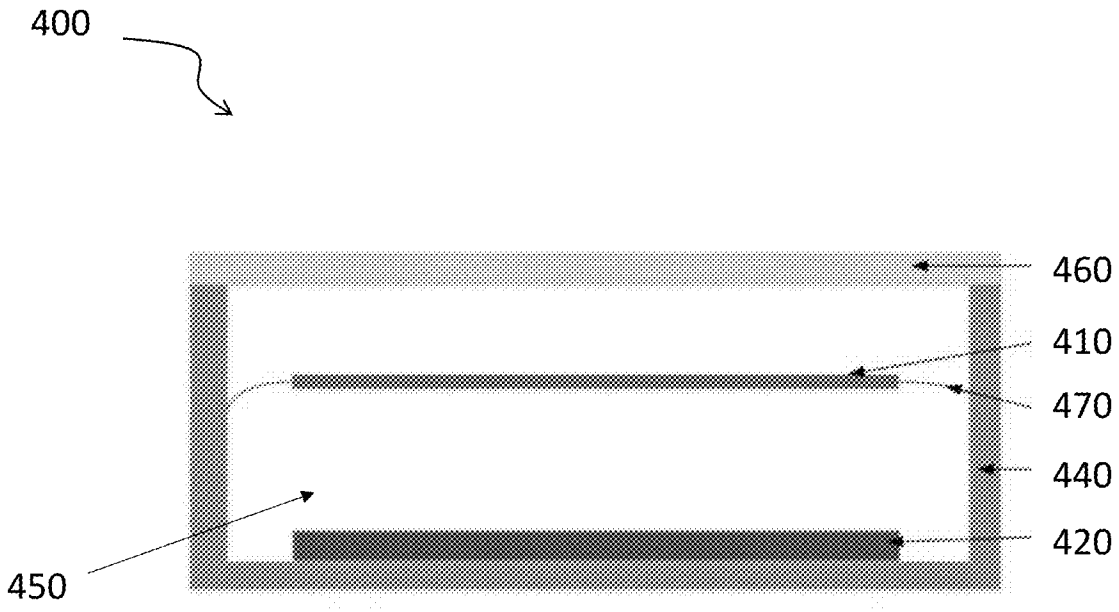
FIG. 4 shows a schematic cross section of a part of light emitter component with suspension webs.

FIG. 4 shows a light emitter component 400 comprising suspension webs 470 in accordance with one example embodiment. In addition to FIG. 3, the light emitter component 400 comprises a covering structure 460. An optical filter can be fitted into or onto the covering structure in order to filter out light of a specific frequency or in a specific frequency range. Furthermore, FIG. 4 shows the suspension of the emitter layer structure 410 by way of webs 470. The arrangement of the emitter layer structure 410 in the cavity 450 results from the consideration about the thermal diffusion. In regard thereto, for low thermal diffusion, the emitter layer structure 410 can be arranged as much as possible in the interior of the cavity 450 between the covering structure 460 and the inductive structure 420 shown in FIG. 4. The cavity 450 is shaped herein as cavity 450 in a carrier substrate 440. The cavity 450 can be filled with air or with a gas (e.g. noble gas or nitrogen). This can lead to a better energy management within the light emitter component 400.

Further details and aspects are mentioned in association with the example embodiments described above or below. The example embodiment shown in FIG. 4 can have one or more optional additional features corresponding to one or more aspects mentioned in association with the proposed concept or one or more example embodiments described above (e.g. FIGS. 1-3) or below (e.g. FIGS. 5-10).

Figure 5:
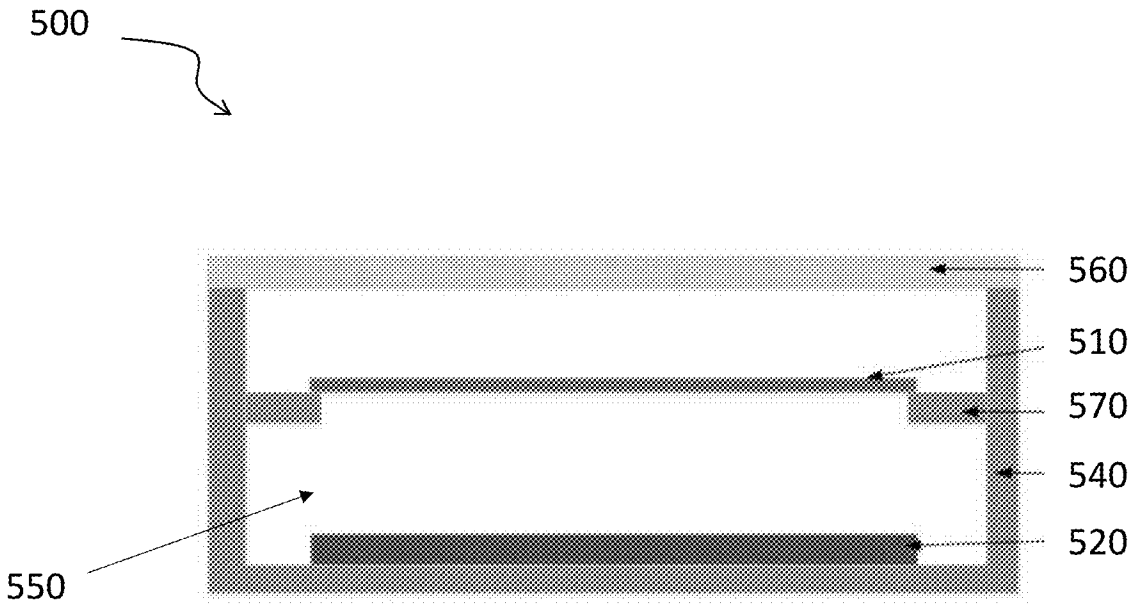
FIG. 5 shows a schematic cross section of a part of a light emitter component with a suspension edge.

FIG. 5 shows a light emitter component 500 with a suspension edge 570. In contrast to FIG. 4, a suspension edge 570 for the suspension of the emitter layer structure 510 is illustrated, instead of the webs.

Further details and aspects are mentioned in association with the example embodiments described above or below. The example embodiment shown in FIG. 5 can have one or more optional additional features corresponding to one or more aspects mentioned in association with the proposed concept or one or more example embodiments described above (e.g. FIGS. 1-4) or below (e.g. FIGS. 6-10).

Figure 6:
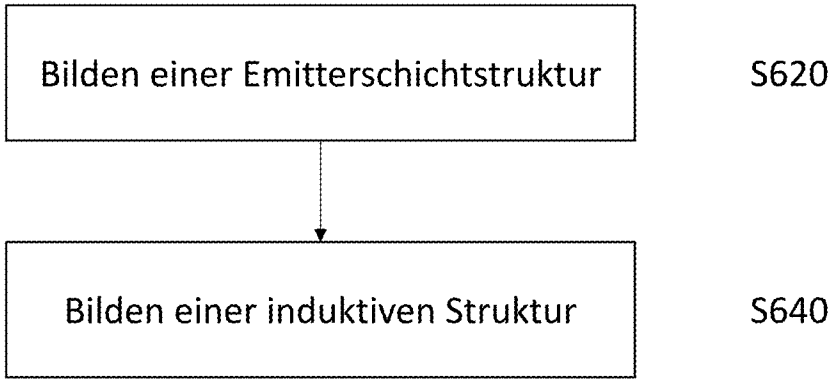
FIG. 6 shows a flow diagram of a method for producing a microelectromechanical light emitter component.
Figure 1:
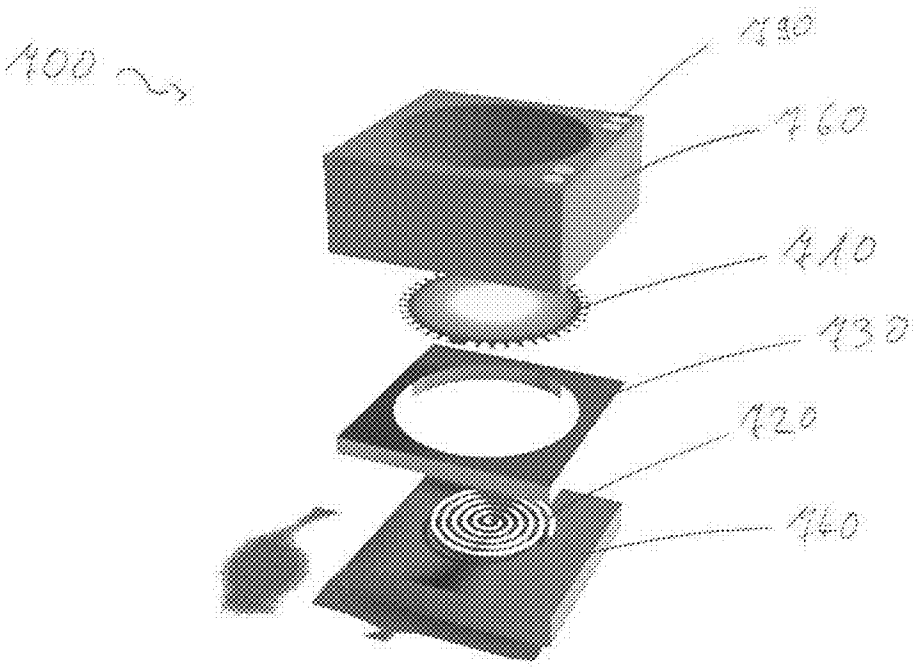

FIG. 6 shows a flow diagram of a method for producing a microelectromechanical light emitter component. The method comprises forming S620 an emitter layer structure of the microelectromechanical light emitter component. The method comprises forming S640 an inductive structure of the microelectromechanical light emitter component, said inductive structure being configured to generate current in the emitter layer structure by electromagnetic induction during operation of the microelectromechanical light emitter component, such that the emitter layer structure emits light. The emitter layer structure is electrically insulated from the inductive structure.

By way of example, the method can furthermore comprise forming an insulating layer on a carrier wafer, for example a silicon wafer. The insulating layer can serve as electrical insulation of the emitter layer structure and/or of the inductive structure vis à vis the carrier wafer and also as an etch stop.

By way of example, the method can additionally comprise etching a cavity between the emitter layer structure and the inductive structure after forming the emitter layer structure and the inductive structure.

By way of example, the method can additionally comprise connecting (e.g. by anodically bonding) the carrier wafer, on which the emitter layer structure and the inductive structure are formed, to a covering structure. The space below the covering structure can be filled with a gas or gas mixture or air with a gas pressure of less than 10 mbar.

By way of example, the method can comprise etching the carrier wafer from the rear side of the carrier wafer as far as the emitter layer structure or as far as the insulating layer. The insulating layer can serve as an etch stop.

By way of example, the method can comprise etching the insulating layer (on the rear side). As a result, the emitter layer structure can then be exposed.

Further details and aspects are mentioned in association with the example embodiments described above or below. The example embodiment shown in FIG. 6 can have one or more optional additional features corresponding to one or more aspects mentioned in association with the proposed concept or one or more example embodiments described above (e.g. FIGS. 1-5) or below (e.g. FIGS. 7-10).

FIG. 7 shows a schematic exploded drawing of a microelectromechanical light emitter component 700 in accordance with one example embodiment.

The microelectromechanical light emitter component 700 comprises a carrier substrate 740, an inductive structure 720, a supporting layer or spacer layer 730, an emitter layer structure 710, a covering structure 760 and two connections/connection pads 790. In this case, a respective connection of the inductive structure 720 can be provided for being connected to a respective connection of the connections/connection pads 790 that is provided for power supply purposes. In this case, the structures and components illustrated schematically in FIG. 7 can have the same functions and modes of functioning as explained in the previous figures.

Further details and aspects are mentioned in association with the example embodiments described above or below. The example embodiment shown in FIG. 7 can have one or more optional additional features corresponding to one or more aspects mentioned in association with the proposed concept or one or more example embodiments described above (e.g. FIGS. 1-6) or below (e.g. FIGS. 8-10).

Figure 8:
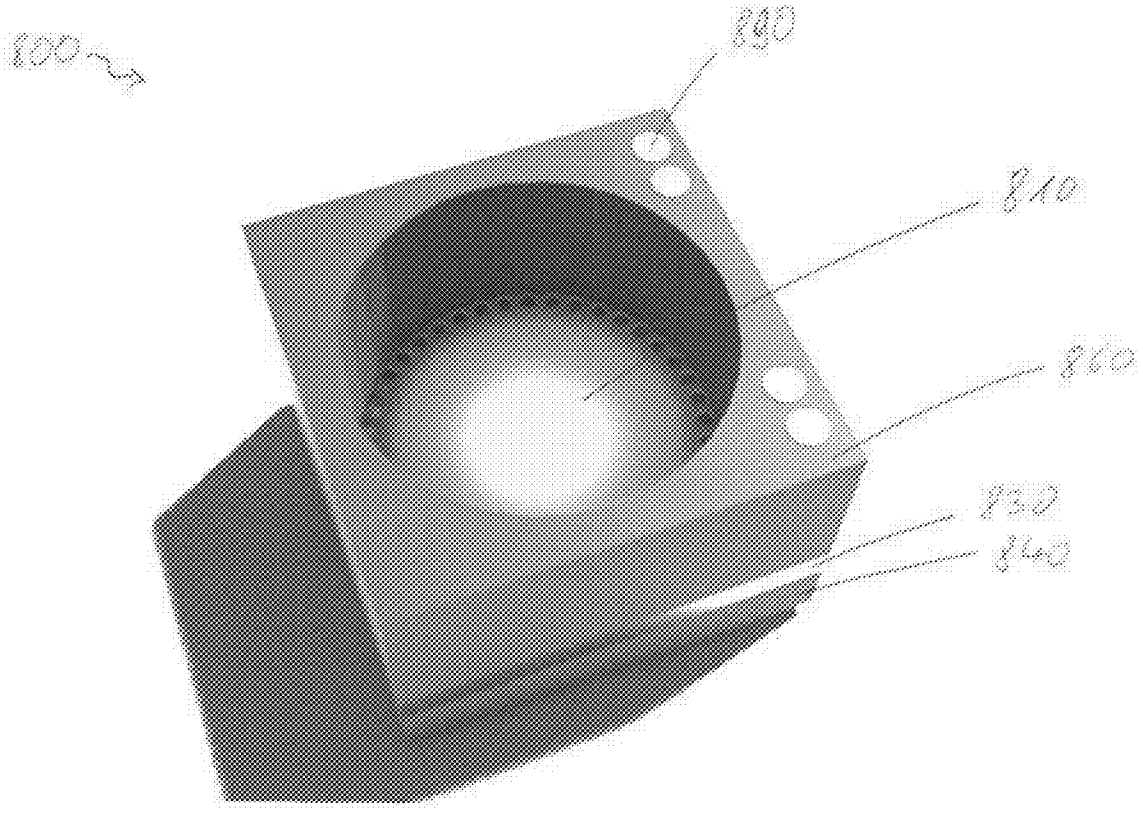
FIG. 8 shows a schematic illustration of a microelectromechanical light emitter component.

FIG. 8 shows a schematic three-dimensional illustration of a microelectromechanical light emitter component 800 in accordance with the example embodiment shown in FIG. 7.

Figure 9:
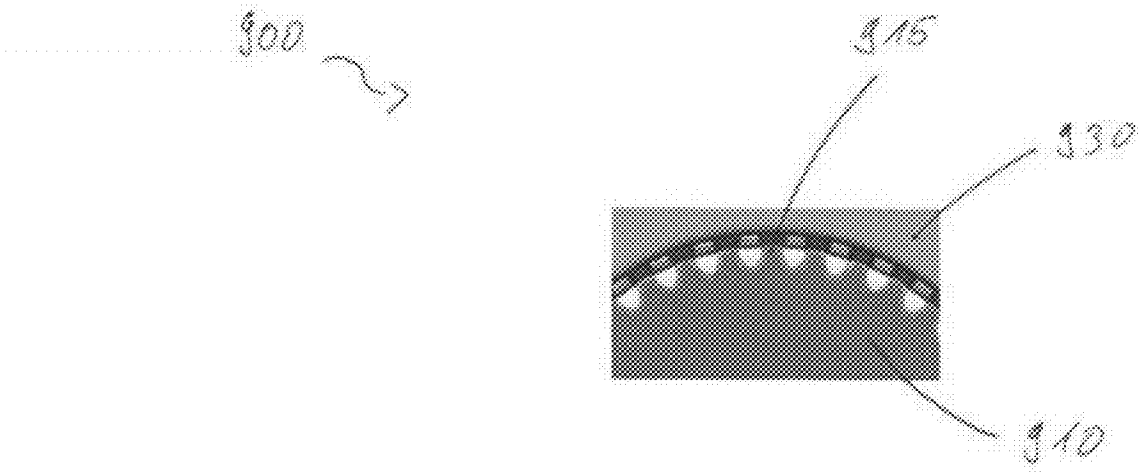
FIG. 9 shows a schematic illustration of an excerpt from a microelectromechanical light emitter component for elucidating the suspension webs of the emitter layer structure of the microelectromechanical light emitter component.

FIG. 9 shows a schematic illustration of an excerpt from the microelectromechanical light emitter component 900 in accordance with the example embodiment shown in FIG. 7 for elucidating the suspension webs 915 of the emitter layer structure 910 of the microelectromechanical light emitter component 900.

Figure 10:
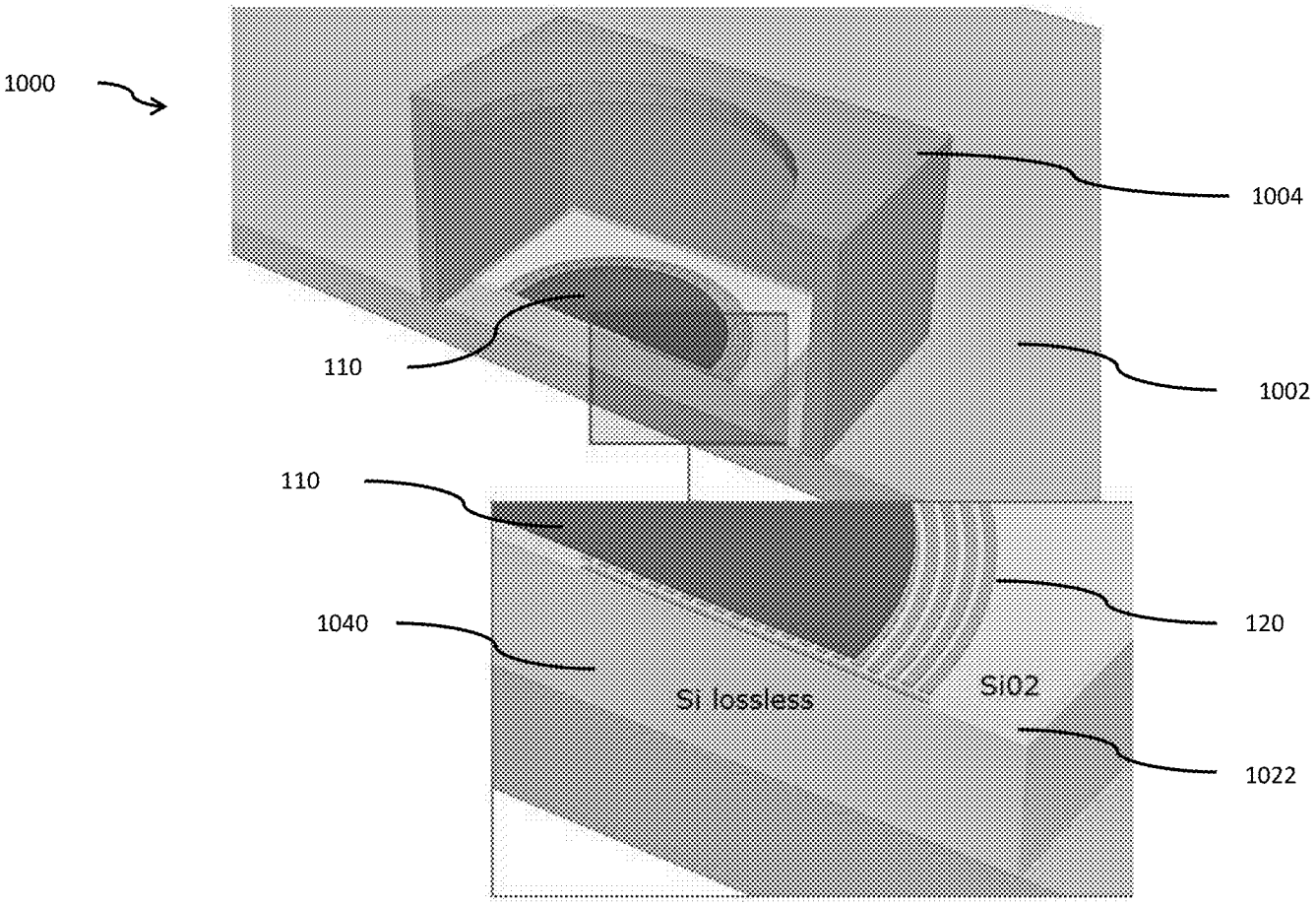
FIG. 10 shows a schematic illustration of an excerpt from a microelectromechanical light emitter component.

FIG. 10 shows a schematic illustration of an excerpt from a microelectromechanical light emitter component in accordance with one example embodiment. The microelectromechanical light emitter component 1000 comprises an emitter layer structure 110 arranged above an inductive structure 120. The inductive structure 120 has a plurality of windings extending spirally in a wiring plane on a semiconductor substrate 1040 (e.g. silicon substrate). The plurality of windings of the inductive structure 120 are arranged parallel to the emitter layer structure 110. A return line of the inductive structure 120, which extends from a radially inner end of the plurality of windings to radially outside the plurality of windings, is arranged in a further wiring plane on the semiconductor substrate 1040. The wiring planes are embedded in silicon dioxide SiO2 and arranged in the region of the emitter layer structure in a manner insulated from the semiconductor substrate 1040. As a result, losses in the silicon semiconductor can be avoided or kept small, for example.

The microelectromechanical light emitter component 1000 can furthermore be secured on a housing substrate 1002 and be enclosed or covered by a housing cover 1004. The housing cover can have an opening or at least one part that is transparent to the light to be emitted, such that the light to be emitted can emerge from the housing.

FIGS. 11A-11D show various possible arrangements of the inductive structure 120 with respect to the emitter layer structure 110 in microelectromechanical light emitter components. The examples for light emitter component (e.g. FIGS. 1-10) as described above or below can comprise an inductive structure which is arranged with respect to the emitter layer structure in a manner such as is shown and described in one of FIGS. 11A-11D.

Figure 11D:
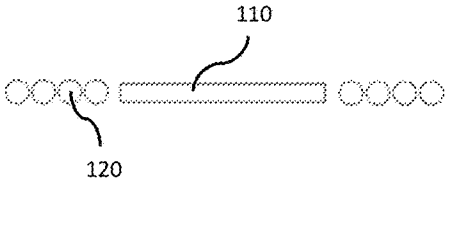
FIGS. 11A-11D show various possible arrangements of the inductive structure with respect to the emitter layer structure in microelectromechanical light emitter components.
Figure 11C:
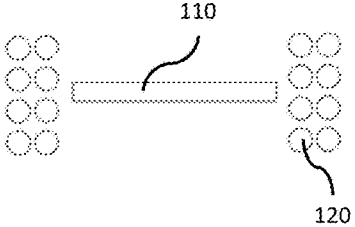
Figure 11B:
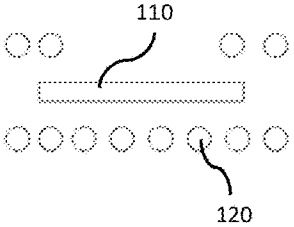
Figure 11A:
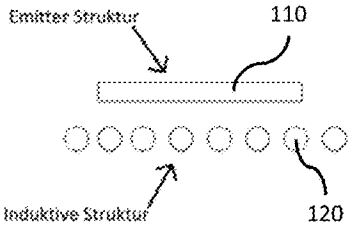

FIG. 11A shows an example in which the inductive structure 120 is a coil arranged at only one side (e.g. below or above) of the emitter layer structure 110.

FIG. 11B shows an example in which the inductive structure 120 comprises one coil having two parts or two coils. In this case, a first part of the coil or one of the two coils is arranged at a first side of the emitter layer structure 110 and a second part of the coil or the other of the two coils is arranged at a second, opposite side of the emitter layer structure 110. In this case, a part of the coil or one of the two coils which is arranged at a side of the emitter layer structure 110 which corresponds to a main emission side of the light emitter component can have a central region that is free of windings of the part of the coil or of said one of the two coils, such that an emission is not disturbed or reduced by the inductive structure. The central region is for example larger than 50% of a lateral extent of the emitter layer structure 110.

FIG. 11C shows an example in which the inductive structure 120 is a coil which surrounds the emitter layer structure 110 laterally outside the region of the emitter layer structure 110. In this example, the emitter layer structure 110 is arranged in the coil and is surrounded by the windings of the coil. In this case, the coil can have windings in a plurality of wiring planes or only in a single wiring plane (e.g. the same wiring plane in which the emitter layer structure is also formed), as is shown in FIG. 11D.

Some example embodiments relate to a light emitter component comprising an emitter layer structure of the light emitter component and an inductive structure of the light emitter component, which are implemented on a semiconductor carrier substrate. The inductive structure of the light emitter component is configured to generate current in the emitter layer structure by electromagnetic induction, such that the emitter layer structure emits light. The emitter layer structure is electrically insulated from the inductive structure.

Further details and aspects of the light emitter component are mentioned in association with the example embodiments described above or below. The example embodiment described can have one or more optional additional features corresponding to one or more aspects mentioned in association with the proposed concept or one or more example embodiments described above (e.g. FIGS. 1-10) or below.

The light emitter component can be for example a microelectromechanical light emitter component as described in association with FIG. 1, or a light emitter component as described in association with FIG. 3.

Some example embodiments relate to inductive infrared emitters (light emitter component) of macroscopic and also micromechanical (microelectromechanical) design, and a method for integrated infrared emitters with increased energy efficiency.

In accordance with one aspect, microelectromechanically based infrared emitters can be used in the course of increasingly widespread use of gas sensors. The microelectromechanically based infrared emitter can consist of a simple resistive layer. The simple resistive layer can be applied on a carrier membrane. An active area (emitter layer structure) can be heated by electric current to temperatures of 500-1000° C. The active area can thereupon emit infrared radiation according to Planck's radiation law.

In accordance with one aspect, the complex layer construction of the active area can be reduced to a single, simple layer. Stresses in the material can be avoided or reduced as a result. Other thermal microelectromechanically based infrared emitters are based on a complicated multilayered construction. A structured metallic heater layer is applied on a carrier membrane, the emitter being heated by said heater layer. Since metallic materials generally have a poor emissivity, said heater layer is also covered with an emission layer. This complex multilayered construction can result in great problems in reliability owing to the multiplicity of materials used and the large temperature differences. Delamination and bursting of the membrane can occur as a result of the strains.

In accordance with one aspect, an electrically conductive suspension may no longer be necessary. An, including thermally, insulating suspension can be used. The latter can crucially contribute to increasing the efficiency. Since an emitter layer would otherwise have to be electrically conductively contacted, electrically conductive connections would also have to be led via the suspension. Since, according to the Wiedemann-Franz law, electrical conductivity is accompanied by thermal conductivity, an improvement in the electrical conductivity also yields an improvement in the thermal conductivity. Undesired losses via thermal diffusion can thus occur.

In accordance with one aspect, a good material for the emitter layer, graphene or graphite, can be used directly as an active layer since an electrical contacting can be omitted. On account of the otherwise very good emissivity of graphene and graphite in the infrared range, these materials can be used as an emissive layer. An electrically conductive, reliable and stable high-temperature linking of these materials can be made possible according to this aspect.

In accordance with one aspect, electrical feeds to the emitter layer can be avoided. Electromigration in feeds and the membrane can be avoided as a result. Otherwise, owing to the high temperatures and current flows, the emitter layer may be subject to in some instances a high degree of electromigration, which can limit the power and lifetime. Primarily emitters based on metallic conduction structures may be subject to electromigration.

In accordance with one aspect, the suspension for the emitter layer can then be embodied in a mechanically simpler manner. In other emitters, emitter layers (emitter membranes) are suspended by complex devices. Since the latter are subject to in part drastic deformation over the heating cycles, the electrically conductive suspensions can be embodied flexibly or with prestress. The electrical conductivity can be omitted according to this aspect.

In accordance with one aspect, the losses as a result of convection can be suppressed by the construction of the emitter in a vacuum cavity. Furthermore, the losses as a result of thermal diffusion can be reduced by means of an improved suspension of the active area. By way of example, the aim of a thermal infrared emitter is to generate the highest possible radiation power. Losses that reduce the latter may be primarily thermal losses alongside the customary electrical losses. Said thermal losses may arise as a result of convection and diffusion. Convection may be influenced by the filling gas within the emitter housing. The thermal diffusion may be influenced by the type and embodiment of the suspension of the emitter layer.

Most problems of other microelectromechanical infrared emitters can be attributed to a complex layer construction of the active area or the suspension thereof. By means of indirectly heating the active layer by induction of electrical energy in the active area by means of a coil, it is possible to simplify both the layer construction and the suspension. In addition, by means of materials such as graphene or graphite, the efficiency of the emitter can thus also be increased A further aspect comprises inductively heating an emissive surface. For example, in a cavity made from Si (since this is transparent to infrared radiation) at the bottom it is possible to apply an induction coil, e.g. the inductive structure. The latter can be embodied either by means of a customary semiconductor metallization process or in some other way. Above this coil it is possible to suspend an emitter area, e.g. the emitter layer structure, which can consist of metallic (e.g.: W) or else nonmetallic (e.g.: C) materials. In order to optimize the heat distribution, the emitter area can also be structured. In order to avoid thermal diffusion, this surface can be suspended from the thinnest possible objects (wires, springs or membranes). The cover of the cavity can be embodied either from the housing material itself or else from a window material with an optical filter applied under certain circumstances. The housing (cover) material itself can consist of metallic or nonmetallic materials or composites. In the case of a hermetic embodiment, the interior of the emitter, e.g. the light emitter component, can optionally be evacuated or filled with a filling gas in order to reduce convection losses. A direct bearing of the emitter surface on the induction coil is also possible. The suspension of the emitter surface can also be embodied as a diaphragm. As a result of the small thickness of the heating structure, a lateral heat transfer can be made very small.

A further aspect comprises at least in part the following steps of a generic process flow:

- coating a silicon wafer with a supporting layer for the emitter area (also functionally as an etch stop for later silicon etching);
- forming the infrared emitter area (for example poly-Si, metal, SiC . . . );
- forming a dielectric isolation;
- forming an inductive heater;
- closing the die, for example using a glass cover;
- rear-side silicon etching;
- rear-side supporting layer etching.

In accordance with one aspect, the production by way of a MEMS process can be cost-effective. In accordance with one aspect, any material available for semiconductor production can be used for the emitter area. In accordance with one aspect, the inductive heater can be completely sealed. In accordance with one aspect, the infrared radiation can be focused.

The aspects and features that have been mentioned and described together with one or more of the examples and figures described in detail above can furthermore be combined with one or more of the other examples in order to replace a similar feature of the other example or in order additionally to introduce the feature into the other example.

The description and drawings present only the principles of the disclosure. Furthermore, all examples mentioned here are intended to serve expressly only for teaching purposes, in order to assist the reader in understanding the principles of the disclosure and the concepts contributed by the inventor(s) for further development of the art. All statements herein regarding principles, aspects and examples of the disclosure and also particular example embodiments thereof are intended to encompass the counterparts thereof.

A block diagram can illustrate e.g. a detailed circuit diagram which implements the principles of the disclosure. In a similar manner, a flow diagram, flowchart, state transition diagram, pseudo-code and the like can illustrate various processes which can substantially be represented in a computer-readable medium and thus be performed by a computer or processor, regardless of whether such a computer or processor is expressly illustrated. Methods disclosed in the description or in the claims can be implemented by a device comprising means for performing each of the corresponding steps of said methods.

Furthermore, it goes without saying that the disclosure of multiple steps, processes, operations, sequences or functions disclosed in the description or the claims should not be interpreted as being in the specific order, unless this is explicitly or implicitly indicated otherwise, e.g. for technical reasons. The disclosure of multiple steps or functions therefore does not limit them to a specific order, unless said steps or functions are not interchangeable for technical reasons. Furthermore, in some examples, an individual step, function, process or sequence can include a plurality of partial steps, functions, processes or sequences or be subdivided into them. Such partial steps can be included and be part of the disclosure of said individual step, provided that they are not expressly excluded.

Furthermore, the claims that follow are hereby incorporated in the detailed description, where each claim can be representative of a separate example by itself. While each claim can be representative of a separate example by itself, it should be taken into consideration that—although a dependent claim can refer in the claims to a particular combination with one or more other claims—other example embodiments can also include a combination of the dependent claim with the subject matter of any other dependent or independent claim. These combinations are proposed here, provided that no indication is given that a specific combination is not intended. Furthermore, features of a claim are intended also to be included for any other independent claim, even if this claim is not made directly dependent on the independent claim.

What is claimed is:

1. A microelectromechanical light emitter component comprising:

an emitter layer structure of the microelectromechanical light emitter component;

an inductive structure of the microelectromechanical light emitter component, wherein the inductive structure is configured to generate current in the emitter layer structure by electromagnetic induction such that the emitter layer structure emits light, and wherein the emitter layer structure is electrically insulated from the inductive structure; and at least one section of a cavity arranged at least vertically between the emitter layer structure and the inductive structure, wherein the emitter layer structure is suspended by one or more elements in the cavity.

2. The microelectromechanical light emitter component as claimed in claim 1, wherein the emitter layer structure is configured and arranged to be free of potential during operation of the microelectromechanical light emitter component.

3. The microelectromechanical light emitter component as claimed in claim 1, wherein the one or more elements comprise a multiplicity of suspension and/or securing webs of the emitter layer structure extending to an edge of the cavity in order to suspend the emitter layer structure at the edge of the cavity.

4. The microelectromechanical light emitter component as claimed in claim 1, wherein the one or more elements comprise a first insulating; and wherein the microelectromechanical light emitter component further comprises a second insulating layer arranged at least partially between the emitter layer structure and the inductive structure and adjoining the emitter layer structure and the inductive structure.

5. The microelectromechanical light emitter component as claimed in claim 1, wherein the inductive structure is arranged with respect to the emitter layer structure such that eddy currents are induced in the emitter layer structure by the inductive structure based on an excitation current flowing through the inductive structure.

6. The microelectromechanical light emitter component as claimed in claim 1, further comprising:

a covering structure of the microelectromechanical light emitter component, wherein the covering structure has a recess in order to form the cavity, and wherein at least another section of the cavity is vertically between the covering structure and the emitter layer structure or the inductive structure.

7. The microelectromechanical light emitter component as claimed in claim 6, wherein the covering structure has an optical filter in the recess such that light, emitted by the emitter layer structure and passing through the optical filter, has a spectral maximum at a particular optical wavelength.

8. The microelectromechanical light emitter component as claimed in claim 1, further comprising:

a multiplicity of emitter layer structures of the microelectromechanical light emitter component, wherein the multiplicity of emitter layer structures are distributed laterally and are electrically insulated from one another.

9. The microelectromechanical light emitter component as claimed in claim 1, wherein the emitter layer structure comprises graphene, graphite, or a composite material comprising nanotubes.

10. The microelectromechanical light emitter component as claimed in claim 1, wherein the inductive structure is a coil.

11. The microelectromechanical light emitter component as claimed in claim 1, wherein the emitter layer structure is arranged between the inductive structure and a carrier substrate.

12. The microelectromechanical light emitter component as claimed in claim 1, wherein the inductive structure is configured to receive an excitation current in order to excite light emission by the emitter layer structure.

13. The microelectromechanical light emitter component as claimed in claim 1, further comprising:

a first connection pad, of the microelectromechanical light emitter component, connected to a first connection end of the inductive structure, and a second connection pad, of the microelectromechanical light emitter component, connected to a second connection end of the inductive structure, wherein the first connection pad and the second connection pad are configured to be connected to an external driver circuit for providing an excitation current to the inductive structure.

14. The microelectromechanical light emitter component as claimed in claim 1, wherein a distance between the emitter layer structure and the inductive structure is greater than 1 μm, and wherein the distance between the emitter layer structure and the inductive structure is less than 1 mm.

15. The microelectromechanical light emitter component as claimed in claim 1, wherein the emitter layer structure is designed to heat up upon excitation of a defined induced current by the inductive structure in order to emit light having an intensity maximum at a frequency of greater than 300 GHz and less than 400 THz.

16. The microelectromechanical light emitter component as claimed in claim 1, wherein the one or more elements comprise one or more suspension edges.

17. The microelectromechanical light emitter component as claimed in claim 1, wherein the emitter layer structure is suspended circumferentially at an edge of the cavity.

18. The microelectromechanical light emitter component as claimed in claim 1, wherein the emitter layer structure is connected to a reference potential during operation.

19. A light emitter component, comprising:

an emitter layer structure;

an inductive structure configured and arranged to generate current in the emitter layer structure by electromagnetic induction such that the emitter layer structure emits light; and at least one section of a cavity that extends vertically from the emitter layer structure as far as the inductive structure, wherein the emitter layer structure extends vertically as far as maximally to a lateral plane of the inductive structure, and wherein the emitter layer structure is suspended by one or more elements in the cavity.

20. A method for producing a microelectromechanical light emitter component, wherein the method comprises:

forming an emitter layer structure of the microelectromechanical light emitter component; and forming an inductive structure of the microelectromechanical light emitter component, wherein at least one section of a cavity is arranged at least vertically between the emitter layer structure and the inductive structure, wherein the emitter layer structure is suspended by one or more elements in the cavity, wherein the inductive structure is configured to generate current in the emitter layer structure by electromagnetic induction during operation of the microelectromechanical light emitter component such that the emitter layer structure emits light, and wherein the emitter layer structure is electrically insulated from the inductive structure.

* * * * *